US006881318B2

(12) United States Patent
Hey et al.

(10) Patent No.: US 6,881,318 B2
(45) Date of Patent: Apr. 19, 2005

(54) DYNAMIC PULSE PLATING FOR HIGH ASPECT RATIO FEATURES

(75) Inventors: H. Peter W. Hey, Sunnyvale, CA (US); Yezdi Dordi, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 200 days.

(21) Appl. No.: 09/916,365

(22) Filed: Jul. 26, 2001

(65) Prior Publication Data

US 2003/0019755 A1 Jan. 30, 2003

(51) Int. Cl.[7] ..... C25D 5/00
(52) U.S. Cl. ..... 205/87; 205/103; 205/291
(58) Field of Search ..... 205/87, 103, 291

(56) References Cited

U.S. PATENT DOCUMENTS 6,004,188 A 12/1999 Roy ..... 451/41
6,235,625 B1 5/2001 Lou ..... 438/618
6,402,924 B1 * 6/2002 Martin et al. ..... 205/103
6,524,461 B1 * 2/2003 Taylor et al. ..... 205/103
6,551,485 B1 * 4/2003 Taylor ..... 205/103

* cited by examiner

*Primary Examiner*—Arun S. Phasge
(74) *Attorney, Agent, or Firm*—Moser, Patterson & Sheridan

(57) ABSTRACT

A method for depositing a metal on a substrate is provided. The metal is deposited by sequentially applying a electrodeposition pulse followed by an electrodissolution pulse to the substrate. After each electrodissolution pulse an before the next electrodeposition pulse there is provided at least one time interval of zero electrical voltage or current, also known as an "off-time", between the pulses. The first two electrodeposition pulses should preferably have the same time durations. Thereafter, the time durations of subsequent electrodeposition pulses are gradually decreased to provide a void-free and seam-free deposition of metal in high aspect ratio features.

21 Claims, 3 Drawing Sheets

DYNAMIC PULSE PLATING FOR HIGH ASPECT RATIO FEATURES

BACKGROUND OF THE DISCLOSURE

1. Field of the Invention

The present invention relates to electrochemical deposition of a metal.

2. Description of the Related Art

Sub-quarter micron, multi-level metallization is one of the key technologies for the next generation of ultra large scale integration (ULSI). The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die.

As circuit densities increase, the widths of vias, contacts and other features, as well as the dielectric materials between them, decrease to less than 250 nanometers, whereas the thickness of the dielectric layers remains substantially constant, with the result that the aspect ratios for the features, i.e., their height divided by width, increases. Many conventional deposition processes have difficulty filling structures where the aspect ratio exceeds 4:1, and particularly where the aspect ratio exceeds 10:1. Therefore, there is a great amount of ongoing effort being directed at the formation of void-free, nanometer-sized features having high aspect ratios wherein the ratio of feature height to feature width can be 4:1 or higher. Additionally, as the feature widths decrease, the device current remains constant or increases, which results in an increased current density in the feature.

Elemental aluminum (Al) and its alloys have been the traditional metals used to form lines and plugs in semiconductor processing because of aluminum's perceived low electrical resistivity, its superior adhesion to silicon dioxide ($SiO_2$), its ease of patterning, and the ability to obtain it in a highly pure form. However, aluminum has a higher electrical resistivity than other more conductive metals such as copper, and aluminum also can suffer from electromigration leading to the formation of voids in the conductor.

Copper and its alloys have lower resistivities than aluminum and significantly higher electromigration resistance as compared to aluminum. These characteristics are important for supporting the higher current densities experienced at high levels of integration and increased device speed. Copper also has good thermal conductivity and is available in a highly pure state. Therefore, copper is becoming a choice metal for filling sub-quarter micron, high aspect ratio interconnect features on semiconductor substrates.

Despite the desirability of using copper for semiconductor device fabrication, choices of fabrication methods for depositing copper into very high aspect ratio features, such as 4:1, having 0.35 $\mu$m (or less) wide vias are limited. As a result of these process limitations, plating, which had previously been limited to the fabrication of lines on circuit boards, is just now being used to fill vias and contacts on semiconductor devices.

Metal electroplating is generally known and can be achieved by a variety of techniques. A typical method generally comprises depositing a barrier layer over the feature surfaces, depositing a conductive metal seed layer, preferably copper, over the barrier layer, and then electroplating a conductive metal over the seed layer to fill the structure/feature. The deposited layers and the dielectric layers can be planarized, such as by chemical mechanical polishing (CMP), to define a conductive interconnect feature.

Electroplating or electrochemical deposition is being projected as an economical and viable solution for future copper interconnect needs. FIG. 1 is a simplified sectional view of a fountain plater 10. Generally, the fountain plater 10 includes an electrolyte container 12 having a top opening, a substrate holder 14 disposed above the electrolyte container 12, an anode 16 disposed at a bottom portion of the electrolyte container 12 and a contact ring 20 contacting the substrate 22. A plurality of grooves 24 are formed in the lower surface of the substrate holder 14. A vacuum pump (not shown) is coupled to the substrate holder 14 and communicates with the grooves 24 to create a vacuum condition capable of securing the substrate 22 to the substrate holder 14 during processing. The contact ring 20 comprises a plurality of metallic or semi-metallic contact pins 26 distributed about the peripheral portion of the substrate 22 to define a central substrate plating surface. The plurality of contact pins 26 extend radially inwardly over a narrow perimeter portion of the substrate 22 and contact a conductive seed layer of the substrate 22 at the tips of the contact pins 26. A power supply 30 is electrically connected to the anode 16 and to the pins 26 thereby providing an electrical bias to the substrate 22. The substrate 22 is positioned above the cylindrical electrolyte container 12 and electrolyte flow impinges perpendicularly on the substrate plating surface during operation of the cell 10.

The electroplating process is typically carried out by applying a constant current density across the substrate plating surface. For example, a constant current density between about 1 and about 60 milliamperes/cm$^2$ (mA/cm$^2$), e.g., about 40 mA/cm$^2$, may be applied across the substrate plating surface to cause deposition thereon. Since the deposition rate is generally a function of the current density applied over the substrate plating surface, the current density is typically increased, e.g., greater than about 40 mA/cm$^2$, to provide faster deposition and increased substrate throughput.

One particular problem encountered in existing electroplating processes is that these electroplating processes have not been able to provide void-free or seam-free fill of high aspect ratio structures. FIG. 2 illustrates a typical deposition result of a high aspect ratio feature 202 on a substrate 200 wherein the mouth/opening 206 of the structure 202 closes off due to overhang or excess deposition of copper at the mouth/opening 206 of the structure 202 also known as crowning. It has been observed that the deposited metal 210 tends to grow much faster at the mouth or opening 206 of the structure 202, resulting in crowning at the mouth/opening 206 of the structure 202 and leaving a void 204 inside the structure 202, as well as a seam 208. The crowning is accelerated by an increase of the current densities during electroplating, thereby causing even larger voids. It has been observed that voids are also formed in the interconnect features due to grain mismatches from the deposition growth. Furthermore, the presence of the seam 208 may result in void formation during subsequent processing such as substrate annealing.

Therefore, there is a need for a method of electrochemical deposition of a metal into high aspect ratio structures on a substrate that provides void-free and seam-free fill of high aspect ratio structures.

SUMMARY OF THE INVENTION

A method for depositing a metal on a substrate is provided. The metal is deposited by sequentially applying a electrodeposition pulse followed by an electrodissolution pulse to the substrate. After each electrodissolution pulse an before the next electrodeposition pulse there is provided at least one time interval of zero electrical voltage or current, also known as an "off-time", between the pulses. The first two electrodeposition pulses should preferably have the same time durations. Thereafter, the time durations of subsequent electrodeposition pulses are gradually decreased to provide a void-free and seam-free deposition of metal in high aspect ratio features.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF THE INVENTION

The invention generally provides a method for electrochemical deposition of a metal on a substrate, resulting in void-free and seam-free metal deposition in high aspect ratio structures. The metal is deposited by sequentially applying a electrodeposition pulse followed by an electrodissolution pulse to the substrate. After each electrodissolution pulse an before the next electrodeposition pulse there is provided at least one time interval of zero electrical voltage or current, also known as an "off-time", between the pulses. The first two electrodeposition pulses should preferably have the same time durations. Thereafter, the time durations of subsequent electrodeposition pulses are gradually decreased to provide a void-free and seam-free deposition of metal in high aspect ratio features.

Figure 5:
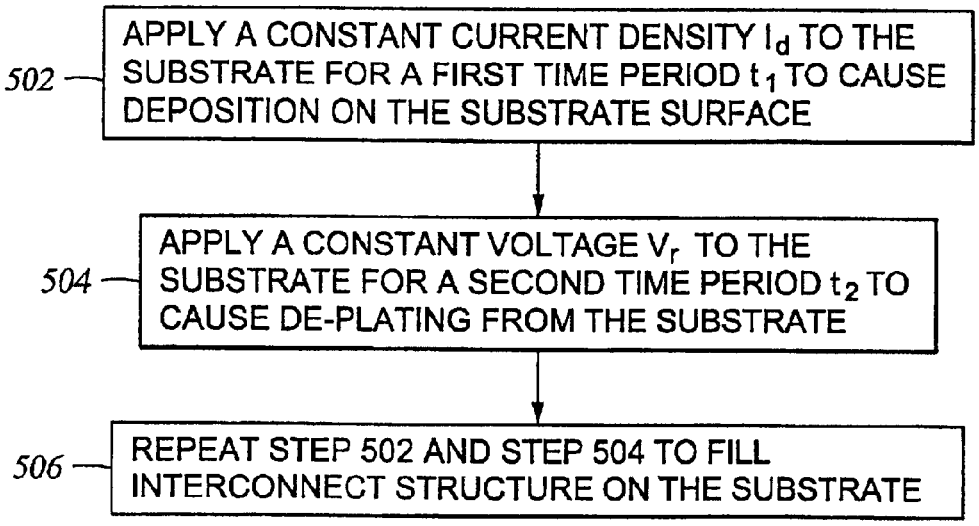
FIG. 5 illustrates a metallization process sequence incorporating the present invention.

The invention can be incorporated within a metallization process sequence such as that shown in FIG. 5. The process sequence of FIG. 5 illustrates steps 502-506 in the formation of a metallization structure in a high aspect ratio feature. A high aspect ratio feature, e.g., a trench or via, is formed on a substrate such as a semiconductor wafer. The trench or via may be formed by conventional lithographic and etching techniques in an insulating layer that has previously been deposited on the wafer. A barrier layer is deposited inside the high aspect ratio feature. The barrier layer, which prevents undesirable diffusion between the underlying substrate and a subsequently deposited metal layer, can be deposited either by chemical vapor deposition (CVD) or physical vapor deposition (PVD). Optionally, an adhesion layer may also be deposited (not shown in FIG. 5) prior to the formation of the barrier layer.

A seed layer of metal is then deposited, by CVD or PVD, on the barrier layer. This metal seed layer is typically relatively thin, and is used to facilitate a subsequent electrochemical deposition (or electroplating) performed in steps 502-506. The seed layer metal may be the same as the metal to be deposited in steps 502-506, or another conductive material such as metal nitride, among others. For example, in copper applications, the seed layer may be copper. However, other metals or conductive materials suitable for promoting electroplating can also be used. For example, noble metals or highly conductive metals such as gold, silver, platinum, palladium, nickel, aluminum, tungsten, tin or their alloys are appropriate. When conductive nitrides such as tungsten nitride Ie-ieed, the nitride layer may also act as a barrier layer.

During steps 502-506, electrochemical plating is performed using a plating solution to deposit a metal layer to a thickness that is at least sufficient to substantially fill the high aspect ratio feature. According to embodiments of the invention, the high aspect ratio feature is filled with the metal in a void-free and seam-free manner by pulse plating techniques using modulated waveforms. In one aspect of the invention, the modulated waveforms comprise electrical pulses of opposite polarities, along with time intervals of zero electrical pulses, or "off-times". The off-times in the plating waveforms allow re-distribution of various chemical species in the plating solution around the high aspect ratio feature to achieve desirable deposition profiles.

The metal is deposited by sequentially applying an electrodeposition pulse (step 502) followed by an electrodissolution pulse (step 504) to the substrate. After each electrodissolutlon pulse and before the next electrodeposition pulse, there is provided at least one time interval of zero electrical voltage or current, also known as an "off-time", between the pulses. The first two electrodeposition pulses should preferably have the same time durations. Thereafter, the time durations of subsequent electrodeposition pulses are gradually decreased to provide a void-free and seam-free deposition of metal in high aspect ratio features, as may be conducted in step 506.

After the formation of the metal layer to a desired thickness, a planarization step may be performed to remove portions of the metal layer that lie outside the high aspect ratio feature, resulting in a planarized metallization structure on the wafer. The planarization may be performed, for example, by chemical mechanical polishing (CMP).

The invention is preferably practiced using an electrochemical deposition cell, such as the Millenia™ Cu ECP system, available from Applied Materials, Inc., Santa Clara, Calif. A detailed description of an electrochemical deposition system is provided in commonly assigned and copending U.S. patent application Ser. No. 09/289,074, entitled "Electro-chemical Deposition System", filed on Apr. 8, 1999, which is hereby incorporated by reference.

Embodiments of the present invention are preferably practiced with a copper electroplating bath having multiple components comprising copper electrolyte and additives such as suppressers and accelerators (also called brighteners). A detailed description of the electroplating chemistry, particularly the composition of the electrolyte and additives, is provided in commonly assigned and copending U.S. patent application Ser. No. 09/245,780, entitled "Electrodeposition Chemistry for Improved Filling of Apertures," filed on Feb. 5, 1999, which is hereby incorporated by reference.

In this exemplary electroplating bath, the copper electrolyte provides the metal ions to be deposited while the suppressers and accelerators control the deposition profile.

For example, the suppressers adsorb on the wafer surfaces and inhibit or reduce copper deposition in those areas where suppressers have been adsorbed. Brighteners or accelerators compete with suppresser molecules for adsorption sites and accelerate copper growth in the areas where brighteners or accelerators have been adsorbed.

In one embodiment, the electrolyte comprises copper sulphate, sulphuric acid and chloride ions. The accelerator or catalyst comprises sulphides, which adsorb strongly on copper in the presence of sulphuric acid. The suppressor may be glycol-based, and may comprise, for example, polyethyl glycol (PEG). The suppressor adsorbs on copper and forms an adherent film in the presence of chloride ions. In the areas with adsorbed suppressor, copper deposition is reduced or inhibited. The activities of suppressers and accelerators depend on various parameters such as temperature, pH and chloride concentration in the electroplating bath, and all of these parameters directly or indirectly affect the polarization of these additives.

The suppressers and accelerators tend to reside over the surfaces in the interconnect structures (i.e., vias and trenches) as soon as the substrate comes into contact with the electroplating bath. Since the molecular dimensions of accelerators are much smaller than that of suppressers, the accelerators can diffuse through the electrolyte faster than the suppressers. Crowning may occur when metal deposition is enhanced by accelerators near the opening of the vias or trenches, and metal ions are depleted inside the vias or trenches. According to embodiments of the invention, the off-times in the plating waveforms allow re-distribution of the concentrations of accelerators, suppressers and metal ions, and ensure metal deposition to be achieved without crowning or void formation.

For void-free deposition in a structure with high aspect ratio features (e.g., vias or trenches), it is desirable that electroplating be suppressed at the top of the topographical structure, while accelerated inside the structure. This will promote a bottom-up growth condition, in which the deposition rate at the bottom of the high aspect ratio feature is greater than that towards the opening or sidewall of the feature, resulting in a "superfill" deposition, which is free of voids or seams. As such, the metal layer is deposited in the via structure, or generally a high aspect ratio feature, in a bottom-up growth manner. Overhang or excess deposition towards the opening of the via structure is avoided, and a void-free and seam-free metal deposition inside the via structure can be achieved.

According to embodiments of the invention, various electrical waveforms are used for pulse plating, and desirable plating results such as a superfill profile can be achieved by proper adjustment of the various electrical pulses. The concentration gradients of metal ions, additives or suppressers in the proximity of the high aspect ratio feature are affected by the sequencing and durations of deposition and dissolution pulses. For example, it is believed that the duration of a deposition pulse controls the deposition on the sidewall of the feature, while the dissolution pulse creates additional metal ions and thus, a concentration gradient of these ions, around the feature. By dissolving some deposited metal from the top of the feature, an electrodissolution pulse (or reverse pulse) allows sufficient time for bottom-up growth within the high aspect ratio feature, without void or seam formation. Furthermore, the deposition and dissolution rates can be controlled by varying the magnitudes of the respective electrical pulses.

It is recognized by the inventors that a catalytic effect, which affects both the deposition and dissolution reaction, is required to achieve superfill deposition. Thus, it is desirable to facilitate the resorption of accelerators by introducing an off-time before an electrodeposition pulse and after an electrodissolution pulse. Typically, the time required for resorption of accelerators depend on the bulk solution concentration of the accelerators, and the off-time is adjusted to be on the order of the diffusion time constant of the accelerator molecules.

Figure 1:
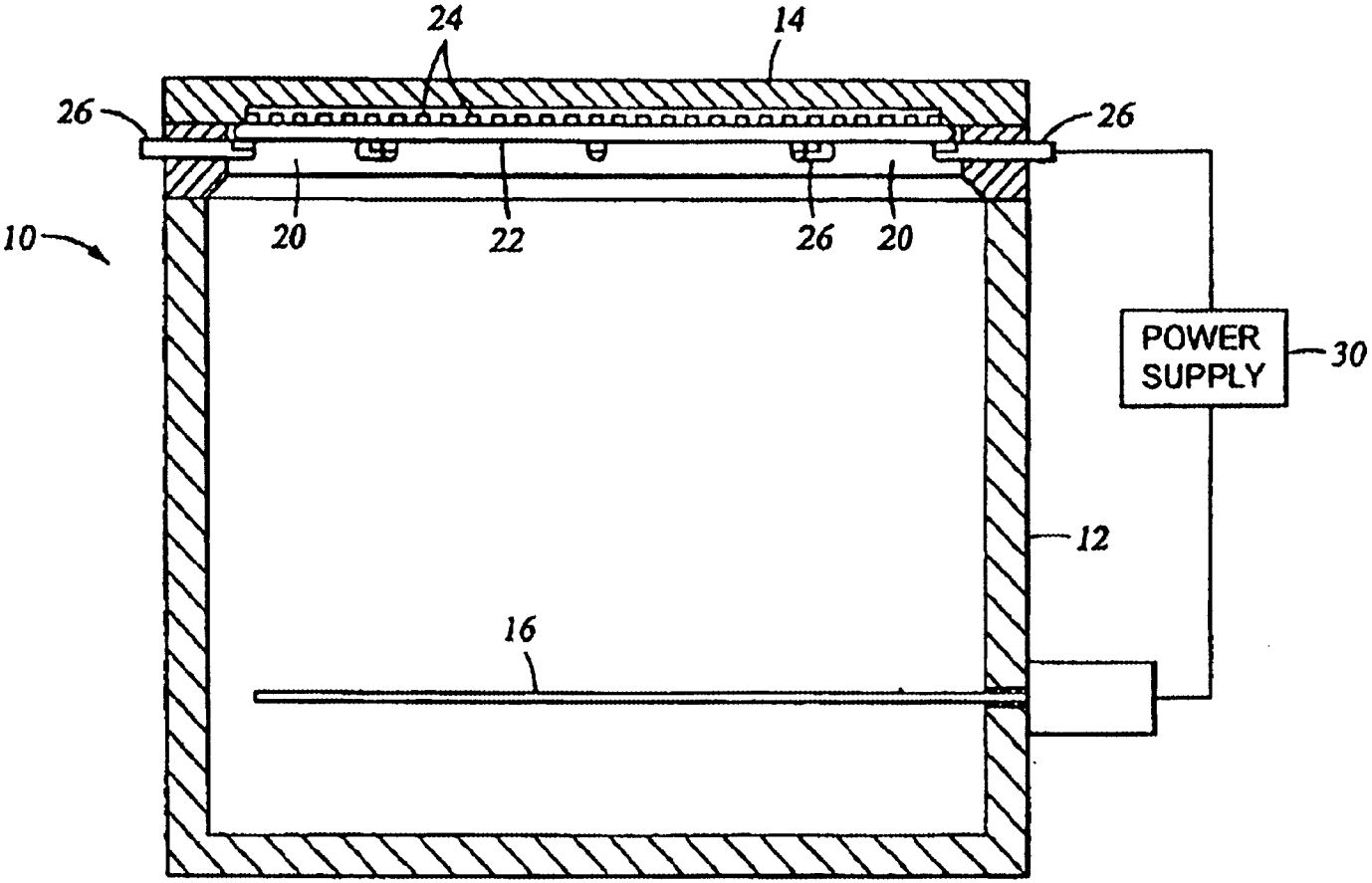
FIG. 1 illustrates a schematic representation of an apparatus suitable for performing electroplating according to the present invention.
Figure 2:
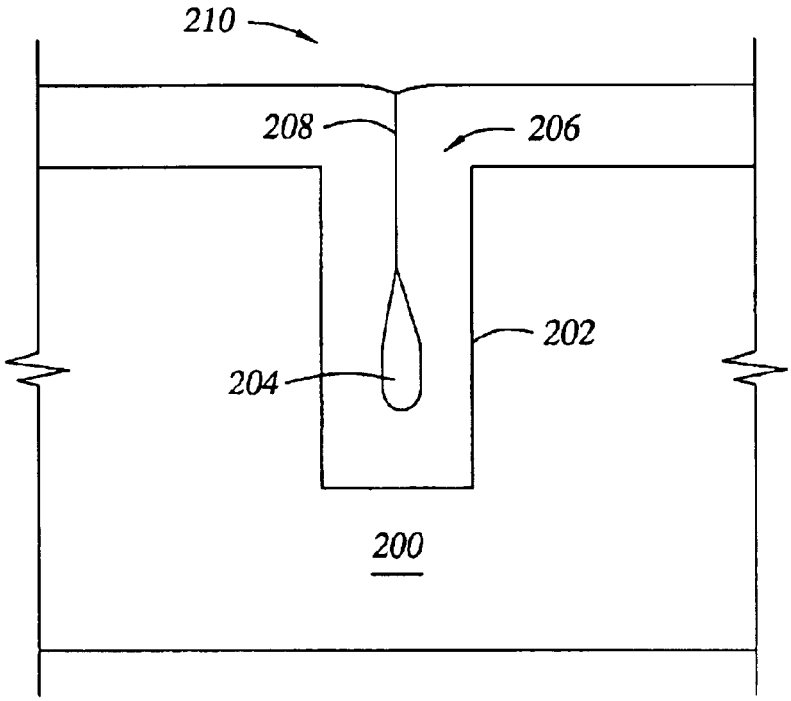
Fig. 2 (PRIOR ART)
FIG. 2 illustrates a schematic cross-sectional view of a typical deposition result of a high aspect ratio feature using prior art techniques.
Figure 3:
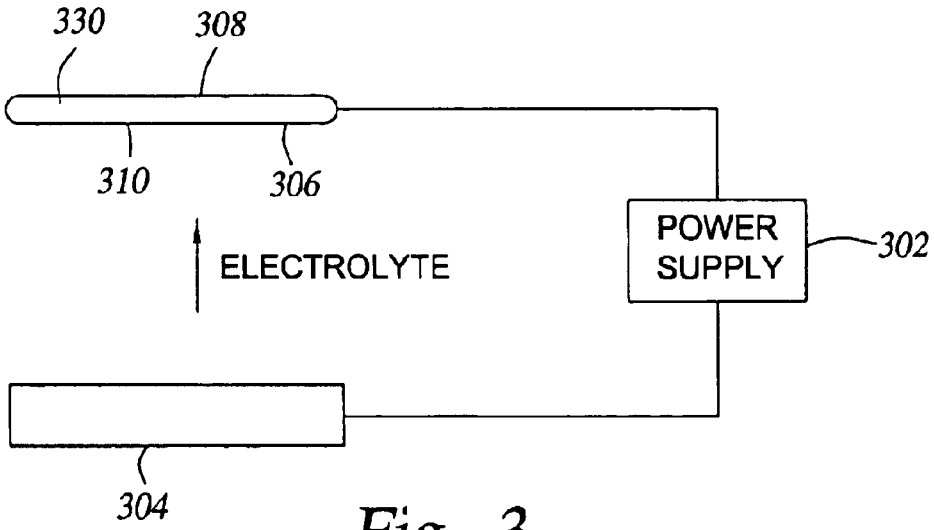
FIG. 3 illustrates electrical connections for practicing the present invention.

FIG. 3 is a schematic diagram showing the electrical connections for an electroplating system according to embodiments of the invention. A power supply 302 is connected to two electrodes 304(e.g., anode) and 308 (e.g., cathode) of an electroplating system. The cathode 308 electrically contacts a seed layer 310 on the plating surface 306 of the substrate 330. The power supply 302 preferably includes a control circuit (not shown) that switches between a constant current operation and a constant voltage operation. The control circuit of the power supply 302 also controls the polarity of the output.

The power supply 302 preferably also includes a switching circuit (not shown) that is programmable to produce a variety of output waveforms, such as an output waveform comprising combinations of a constant voltage or current output for a first duration, a constant voltage or current output for a second duration, and an "off-time" corresponding to zero voltage or current output. The invention contemplates utilizing a variety of power supply designs that arecapable of producing such output waveforms and is. not limited to any particular power supply design.

According to embodiments of the invention, pulse plating is used in conjunction with provisions of an 3off-time, to control the electrodeposition and electrodissolution of metal in the vicinity of the high aspect ratio structure. Although the present discussion focuses on the effect around a high aspect ratio feature, it is recognized that the off-time may also affect metal deposition and dissolution in other areas of the substrate. In pulse plating, electrical pulses—either voltage or current pulses, are applied to the substrate 330 in certain combinations. These pulse combinations may comprise different sequences of pulses of different polarities to achieve metal deposition or metal dissolution. This contrasts with DC plating, in which a continuous voltage or current is applied to the substrate for a time duration for metal deposition.

Figure 4:
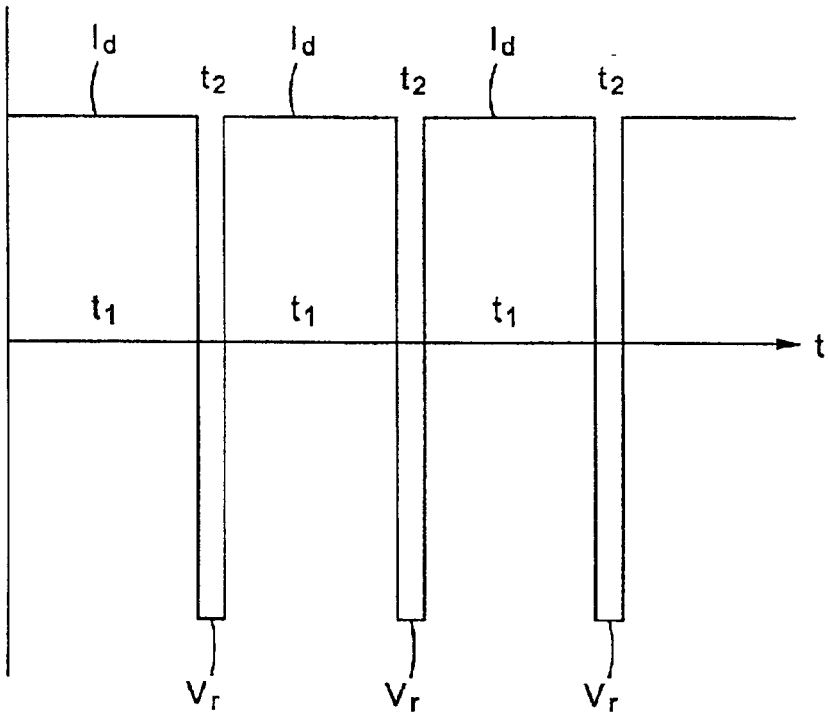
FIG. 4 depicts different waveforms for electroplating deposition.

FIG. 4 illustrates a pulse plating waveform having current pulses with different polarities. In this example, current pulses $1_d$ correspond to electrodeposition pulses, during which copper ions in the electrolyte are accelerated towards the cathode 306 resulting in the plating of copper on the substrate 330. The negative current pulses $V_r$ correspond to electrodissolution pulses, during which the copper that has been plated on the substrate 330 is dissolved by being converted into copper ions In the electrolyte. By using different combinations of electrical pulses of opposite polarities, plating of copper can be achieved with varying profiles. To achieve superfill in a high aspect ratio structure, e.g., a via or trench, it is desirable to have a higher current density at the bottom than at the top of the structure.

In general, there are three pulse plating time durations of interest: 1) electrodeposition pulse time duration; 2) electrodissolution pulse time duration; and 3) Off-time. Typically, the specific choices for the electrodeposition and electrodissolution pulse time durations depend on the aspect ratios of the structures to be filled, and process optimization may involve, for example, varying the ratio of the electrodeposition pulse time duration to the electrodissolution pulse time duration. After each electrodeposition pulse, a concentration gradient of copper ions is created inside the via due to the consumption of copper ions. It is found that if the copper ion distribution and the concentration gradient of additives generated during the electrodissolution step are not balanced, crowning or void formation can occur.

Therefore, the durations for the off-times are selected to establish proper concentration gradients, or redistribution of the various copper or additive species in the vicinity of the structure. For example, the off-time duration may be selected to be on the order of the diffusion time constant of a certain species of interest. For example, the diffusion time $\tau$ for any of the species in the electroplating bath may be approximated by: $\tau=h^2/D$, where h represents the depth of the via, and D represents the diffusivity of the species. In one embodiment, electroplating is performed on vias having a depth of about 1.6 $\mu$m. With the electroplating bath used in this embodiment, the diffusivity of the additives is believed to be one or two orders of magnitudes lower than that of copper. For a 1.6 $\mu$m via, for example, the diffusion time for additives is estimated to be about 50 milliseconds (ms). Thus, an off-time duration of about 100 ms may be selected in the plating waveform, to allow for a sufficiently long time for the additives to diffuse and establish the proper concentration distribution for a void-free and seam-free filling of the via.

Additionally, since the diffusivity of the species varies as a function of temperature, the specific bath temperature may also affect the choice of the off-time durations. In general, since the molecular dimensions of catalysts or accelerators are smaller than that of the suppressers, the diffusion of catalysts is also faster than that of suppressers.

Although each electrical pulse shown in FIG. 4 has a constant amplitude within the pulse duration, it is also possible to use plating pulses with amplitudes that are ramped as a function of time. In addition, it is not necessary that all electrodeposition (or electrodissolution) pulses have the same amplitudes within one plating waveform.

In general, the time durations of each pulse and the off-time may be different from each other, and can be adjusted according to specific desired profiles or properties of the deposited metal. For example, the off-time duration may range from about 1 ms to about 500 ms. The pulse duration for an electrodeposition (cathodic) pulse may range from about 500 ms to about 3000 ms, while that for an electrodissolution pulse (anodic) may range from about 1 ms to about 300 ms.

In embodiments described herein, the first two electrodeposition pulses should preferably have the same time durations. Thereafter, the time durations of subsequent electrodeposition pulses are gradually decreased to provide a void-free and seam-free deposition of metal in high aspect ratio features.

The time of the pulse durations depends on the width and aspect ratio of the feature, as well as on the current densities used. For example, a smaller feature (or higher aspect ratio) would typically require a lower ratio of electrodeposition pulse duration to electrodissolution pulse duration. The amplitude of an electrodeposition pulse is typically in the range of about 0.5 Amp to about 10 Amp, while that of an electrodissolution pulse may range from about 3 Amp to about 60 Amp. The magnitudes of deposition and dissolution current densities are determined based on various considerations such as the requirement for superfill profile and process throughput, among others.

In addition, the use of an off-time may also be combined with DC plating. For example, DC electrodeposition pulses followed by respective off-time durations may be used to provide thick metal layers. A DC current density of between about 1 and about 60 milliamperes/cm$^2$ may be used.

EXAMPLE

An example is given below of copper electroplating according to one embodiment of the invention on a substrate having high aspect ratio interconnect features. Prior to electroplating, a barrier layer comprising about 250 Å of tantalum nitride is deposited by physical vapor deposition over the substrate using processing parameters that are known in the art. Preferably, the barrier layer is deposited using a Vectra IMP™ chamber from Applied Materials, Inc., Santa Clara, Calif.

A copper seed layer having a thickness of about 2000 Å is formed on the barrier layer, using, for example, known processing parameters for physical vapor deposition. The substrate is then transferred to an electroplating cell, e.g., a Millenia™ ECP system, available from Applied Materials, Inc., for copper electroplating.

In this embodiment, the electroplating bath comprises 0.85 M copper sulphate, appropriate additives (suppressers and accelerators) and chloride ions at about 60 to about 70 ppm, with a bath pH of about 1.0 at a temperature of about 15° C. The additives, accelerator "X" and suppresser "Y" were supplied by Lea Ronal (or Shipley Ronal) of New York, and are known as Electra plate X Rev 1.0 and Electra plate Y Rev 1.0, which is also known as SB additive.

The plating waveform comprises a positive electrodeposition pulse having an amplitude of about 3 Amp and a duration of up to about 3 s, a negative pulse electrodissolution pulse duration of about 100 ms and an amplitude of between about 25 Amp to about 40 Amp, preferably about 30 Amp, along with an off-time duration of about 100 ms after the electrodissolution pulse. About 15 to 20 cycles (comprising a sequence of electrodeposition, electrodissolution and off-time) are used to achieve void-free filling of 1.6 $\mu$m deep, sub-0.25 $\mu$m vias. After the second cycle, the electrodeposition pulse duration of each subsequent cycle is preferably reduced by about 5 ms to about 50 ms so as to promote bottom up growth within the vias.

Additionally, hydrogen given off during the dissolution pulse may be trapped inside the vias of the wafer. Thus, it is generally desirable to incorporate an off-time after the dissolution pulse that is sufficiently long to allow for hydrogen to escape from the vias.

Although several preferred embodiments which incorporate the teachings of the present invention have been shown and described in detail, those skilled in the art can readily devise many other varied embodiments that still incorporate these teachings.

What is claimed is:

1. A method for electroplating a metal on a substrate, comprising:

sequentially applying two or more cycles comprising an electrodeposition pulse followed by an electrodissolution pulse to the substrate, wherein each electrodeposition pulse has a first time duration and each electrodissolution pulse has a second time duration equal to or less than the first time duration, and wherein the first time duration of each electrodeposition pulse of subsequently applied cycles is reduced.

2. The method of claim 1 wherein a time interval of zero electrical pulse separates each cycle.

3. The method of claim 2 wherein the time interval of zero electrical pulse is between about 1 millisecond and about 500 milliseconds.

4. The method of claim 2 wherein each electrodeposition pulse has an amplitude between about 0.5 amperes and about 10 amperes.

5. The method of claim 2 wherein each electrodeposition pulse has a time duration between about 500 millisecond and about 3000 milliseconds.

6. The method of claim 1 wherein each electrodissolution pulse has an amplitude between about 3 amperes to about 60 amperes.

7. The method of claim 1 wherein the electrodissolution pulse has a time duration between about 1 millisecond to about 500 milliseconds.

8. The method of claim 2 wherein the time duration of electrodeposition pulse of subsequently applied cycles is reduced by about 5 milliseconds to about 50 milliseconds.

9. The method of claim 1 wherein the substrate is in an electroplating bath comprising a chemical having a diffusion time constant about equal to the time interval of zero electrical pulse.

10. The method of claim 9 wherein the electroplating bath further comprises copper ions.

11. A method for electroplating a metal on a substrate having a trench, comprising the steps of:

(a) sequentially applying two or more cycles comprising an electrodeposition pulse followed by an electrodissolution pulse to the substrate, wherein each electrodeposition pulse has a first time duration and each electrodissolution pulse has a second time duration equal to or less than the first time duration, and wherein the first time duration of each electrodeposition pulse of subsequently applied cycles is reduced; and (b) applying a DC current to the substrate to deposit the metal to a desired thickness on the substrate.

12. The method of claim 11, further comprising the step of providing a time interval of zero electrical pulse separates each cycle.

13. The method of claim 12 wherein the time interval of zero electrical pulse is between about 1 millisecond and about 500 milliseconds.

14. The method of claim 12 wherein each electrodeposition pulse has an amplitude between about 0.5 amperes and about 10 amperes.

15. The method of claim 12 wherein each electrodeposition pulse has a time duration between about 500 millisecond and about 3000 milliseconds.

16. The method of claim 11 wherein each electrodissolution pulse has an amplitude between about 3 amperes to about 60 amperes.

17. The method of claim 11 wherein the electrodissolution pulse has a time duration between about 1 millisecond to about 500 milliseconds.

18. The method of claim 12 wherein the time duration of electrodeposition pulse of subsequently applied cycles is reduced by about 5 milliseconds to about 50 milliseconds.

19. The method of claim 11 wherein step (a) is performed with the substrate in an electroplating bath comprising a chemical having a diffusion time constant about equal to the time interval of zero electrical pulse.

20. The method of claim 19 wherein the electroplating bath further comprises copper ions.

21. A method for electroplating a metal on a substrate, comprising:

sequentially applying two or more cycles comprising an electrodeposition pulse followed by an electrodissolution pulse to the substrate, wherein each electrodeposition pulse has a first time duration and each electrodissolution pulse has a second time duration equal to or less than the first time duration, wherein the first time duration is from about 500 milliseconds to about 3,000 milliseconds, and wherein the first time duration of each electroderosition pulse of subsequently aoolied cycles is reduced.

* * * * *

UNITED STATES PATENT AND TRADEMARK OFFICE

CERTIFICATE OF CORRECTION

PATENT NO. : 6,881,318 b2
DATED : April 19, 2005
INVENTOR(S) : H. Peter W. Hey and Yezdi Dordi It is certified that error appears in the above-identified patent and that said Letters Patent is hereby corrected as shown below:

Column 10,
Line 35, change "aoolied" to -- applied --.

Signed and Sealed this

Twenty-eighth Day of March, 2006

JON W. DUDAS
*Director of the United States Patent and Trademark Office*